United States Patent [19]

Olejniczak

[11] Patent Number: 4,817,285

[45] Date of Patent: Apr. 4, 1989

[54] RAZOR BLADE HOLDER

[75] Inventor: Andrzej J. Olejniczak, New York, N.Y.

[73] Assignee: O & J Design, New York, N.Y.

[21] Appl. No.: 33,689

[22] Filed: Apr. 3, 1987

[51] Int. Cl.[4] ..... B26B 21/00

[52] U.S. Cl. ..... 30/47; 30/333

[58] Field of Search ..... 30/47, 332, 333, 335, 30/337, 339, 329, 169

[56] References Cited

U.S. PATENT DOCUMENTS 208,593 10/1878 Hansen et al. ..... 30/329 X 2,292,729 8/1942 Woodward ..... 30/112 X

*Primary Examiner*—Douglas D. Watts

*Attorney, Agent, or Firm*—Cushman, Darby & Cushman

[57] ABSTRACT

A razor blade holder including a longitudinal slot for receiving a razor blade, first and second offset finger gripping elements and a clamping element provided within the slot for clamping a razor blade in the slot of the holder. The holder grips the blade with the point ready to use. Further, the blade is tightly clamped in the blade receiving slot so that the likelihood of movement of the blade relative to the holder minimized. In addition, the offset relation of the finger gripping elements enables the holder to be balanced to fit ergonomically between two or three fingers and thus fits relatively naturally within the hand and grip of the user.

14 Claims, 2 Drawing Sheets

RAZOR BLADE HOLDER

BACKGROUND OF THE INVENTION

The present invention relates to razor blade holders and, more particularly, a razor blade holder for a single edge razor blade for facilitating a user's grip on the razor blade during cutting and which grips the blade tightly so as to minimize movement of the blade relative to the holder during the cutting operation.

SUMMARY OF THE INVENTION

The present invention is designed to improve the ability of graphic artists and architects to use conventional single edge or "industrial" razor blades for the purpose of cutting fine lines. More particularly, it is an object of the present invention to enable a sure and steady toll as compared to use of the blade alone.

It is the further object of the present invention to provide a naturally formed holder that comfortably rests in the fingers and hand of the user so as to enable a firm grip on the holder.

Yet another object of the present invention is to provide a razor blade holder that enables the efficient control of the blade during the cutting function and yields a more precise cutting operation and result.

The foregoing objects are realized in accordance with the present invention by providing a razor blade holder including a longitudinal slot for receiving a razor blade, first and second offset finger gripping elements and a clamping element provided within the slot for clamping a razor blade in the slot of the holder.

The holder grips the blade with the point ready to use. Further, the blade is tightly clamped in the blade receiving slot so that the likelihood of movement of the blade relative to the holder is minimized. The offset relation of the finger gripping elements enables the holder to be balanced to fit ergonomically between two or three fingers and thus fits relatively naturally within the hand and grip of the user. As such, the user is able to apply the appropriate degree of cutting pressure to control the cutting function while reducing the energy required to move the blade through an associated medium and hence reducing cramping and fatigue.

Other objects, features, and characteristics of the present invention, as well as the methods of operation and functions of the related elements of the structure and the combination of the part and economic of manufacture, will become more apparent upon consideration of the following description and appended claims with reference to the accompanying drawings, all of which form a part of this specification, wherein like reference numerals designate corresponding parts in the various figures.

DETAILED DESCRIPTION OF THE PRESENTLY PREFERRED EMBODIMENT

Figure 1:
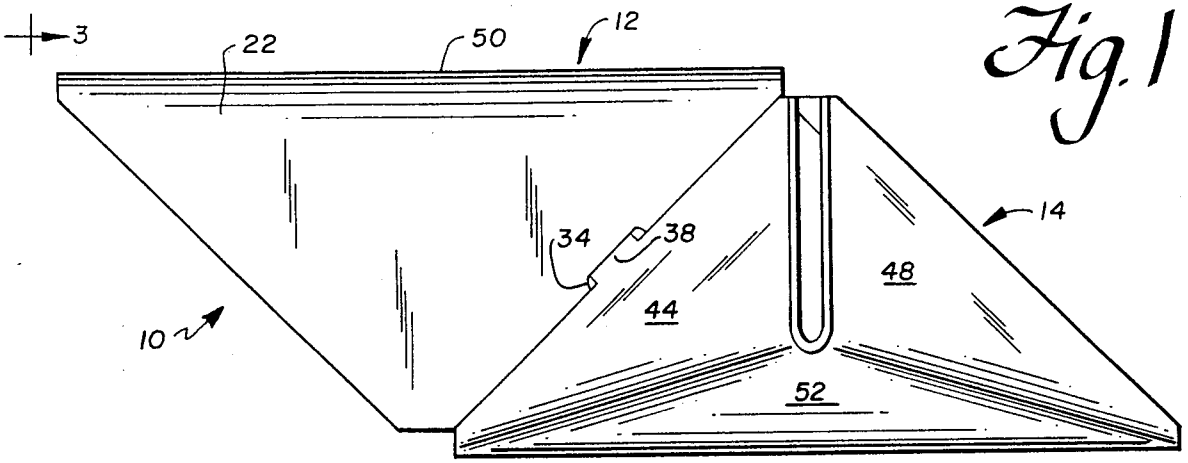
FIG. 1 is a left side elevational view of a razor blade holder formed in accordance with the present invention.
Figure 2:
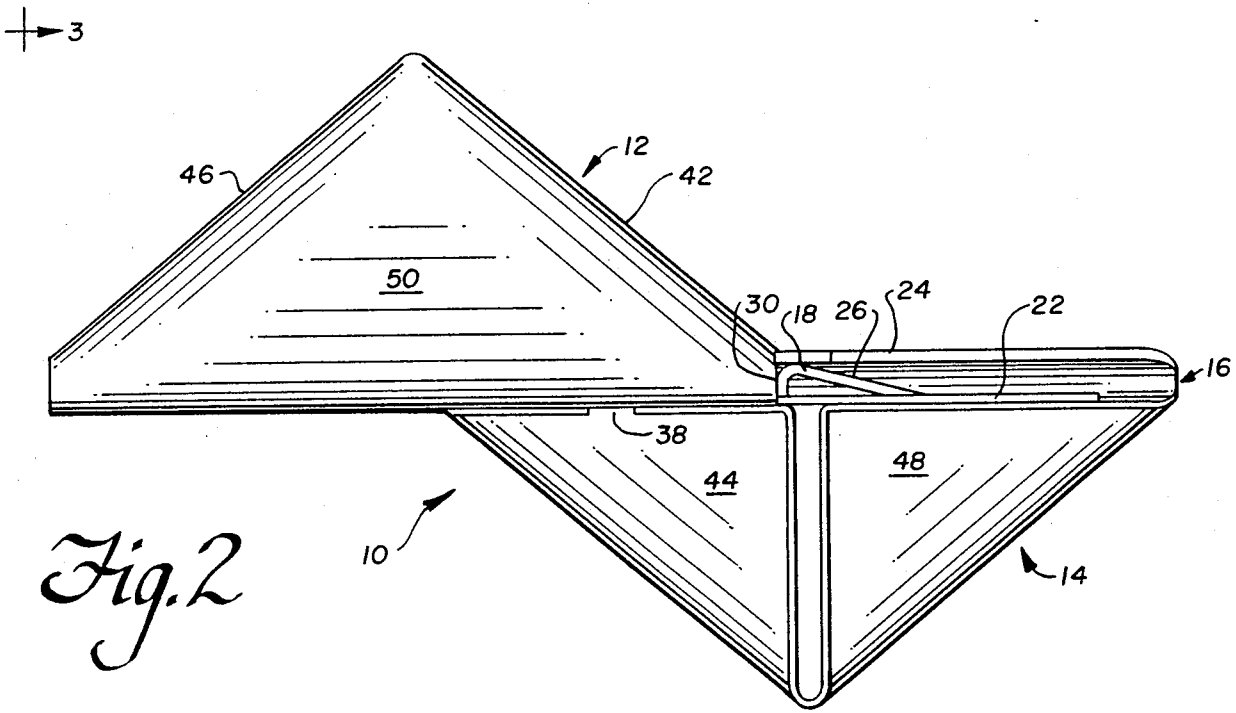
FIG. 2 is a top plan view of a razor blade holder formed in accordance with the present invention.

Referring to FIGS. 1 and 2, a razor blade holder 10 formed in accordance with the present invention is shown. As will become more apparent below, for a right handed user, the illustrated holder has a right sided finger grip 12 adjacent the forward end thereof and a left sided finger grip 14 adjacent a rearward portion thereof. However, for use by a left handed person, holder 10 need only be turned over and the razor blade inserted in the opposite end so that the left sided finger grip is at the forward end of holder 10.

Figure 3:
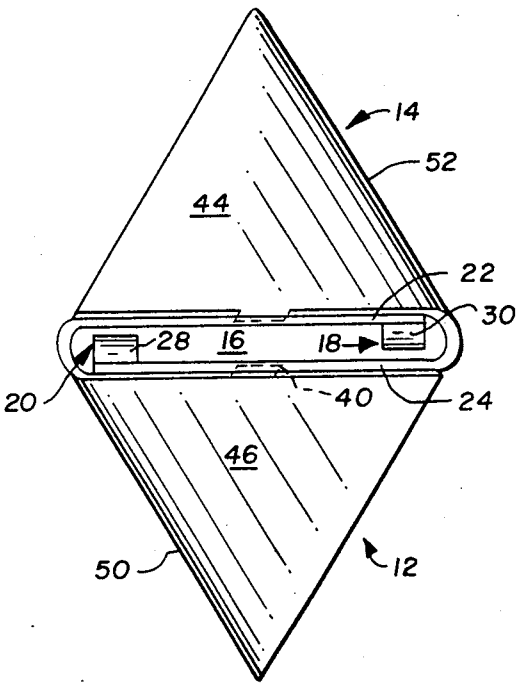
FIG. 3 is a view taken along line 3—3 of FIG. 1.

Referring to FIGS. 2 and 3, holder 10 defines a razor blade receiving slot 16 and preferably includes at least first and second clamping elements 18, 20 for clamping a razor blade (not shown) within slot 16. Slot 16 is defined by first and second longitudinal wall elements 22, 24 which are respectively coupled to right and left finger grips 12, 14 to define right and left "parts" of holder 10. Further, clamping elements 18, 20 are preferably protrusions formed along the length of walls 22, 24, adjacent the longitudinal edges thereof to provide maximum clamping stability. While in the illustrated embodiment the clamping element defined along the longitudinal walls is in the form of a cut out protrusion, it is to be understood that this protrusion could be formed by simply deforming a portion of the longitudinal wall element to form a protrusion that is not cut from the wall element or, in the alternative, a separate protrusion element can be affixed to the longitudinal wall element. Clamping elements 18, 20 include inclined surfaces 26, 28 and stop faces 30, 32 so that they each act both as a clamp for the blade and as a stop for limiting insertion of the blade. More particularly, when a blade is inserted into the forward end of holder 10 from the left in FIG. 2, it will engage inclined surface 28 of element 20 so as to be clamped by element 20 against wall 2. Further insertion of the blade then causes the inner most end of the blade to engage stop face 30 of element 18. Thus, element 18 acts as a stop for limiting insertion of the blade. On the other hand, when the blade is inserted into the other end of holder 10, for example, when it is used by a left handed person, element 18 acts as a clamp, clamping the blade against wall 24, and stop face 32 of element 20 acts as a stop.

Figure 6:
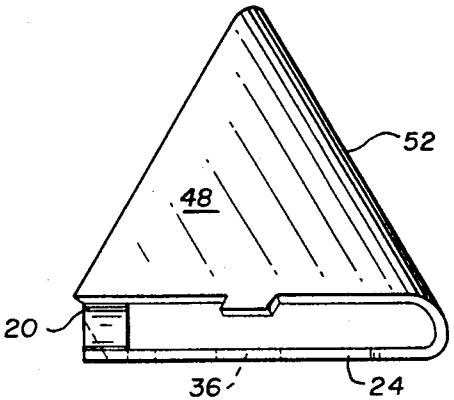
FIG. 6 is a view taken along line 6—6 of FIG. 4.
Figure 4:
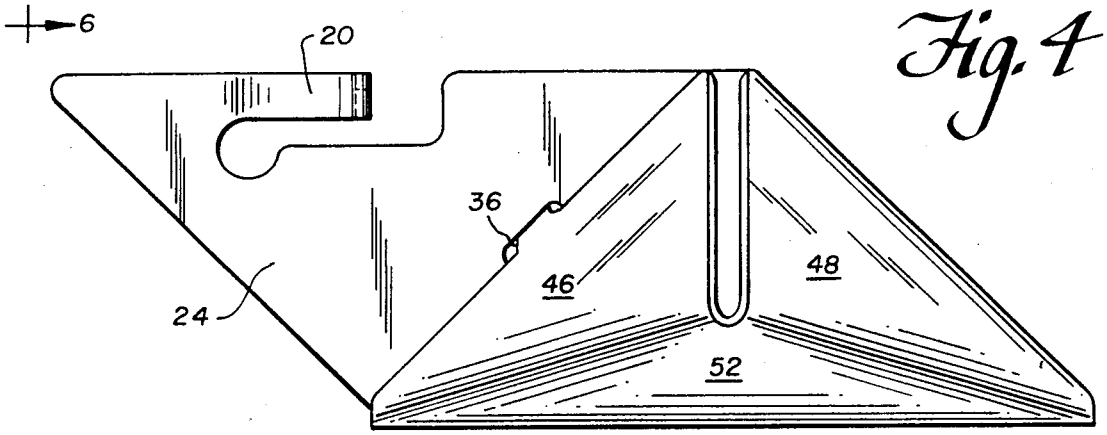
FIG. 4 side elevational view of a left part of the holder formed in accordance with invention.
Figure 5:
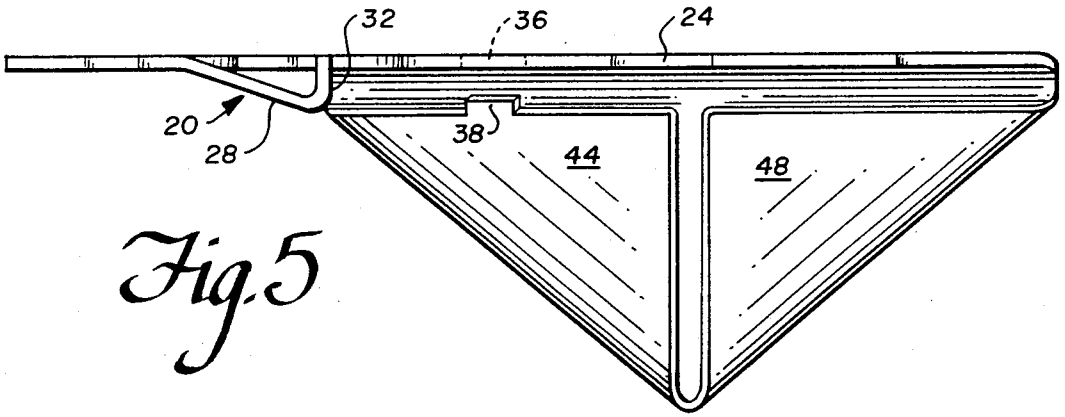
FIG. 5 is top plan view of the left part of the razor holder formed in accordance with the present invention.

Turning now to FIGS. 4–6, the left part of a razor blade holder formed in accordance with the present invention is shown. The right part is substantially identical to the left part but is formed so as to be the mirror image thereof as will become more apparent below.

Longitudinal wall elements 22, 24 of the right and left parts of holder 10 are rigidly coupled to the finger gripping portion 14, 12 of the opposite part to define slot 16. More particularly, the left and right parts of the razor blade holder are rigidly fixed together by means of a notch 34, 36 defined in each longitudinal wall element 22, 24 in which a tooth 38, 40 formed on the finger gripping elements 14, 12 of the opposite part fits. The engagement of notches 34, 36 and teeth 38, 40 provides a lock and key interfitment which couples the left and right parts of the assembled holder together.

Finger gripping portions 12,14 can be formed as solid protrusions and can be of any shape desired to provide the requisite handling of the holder. In the preferred embodiment, however, the finger grips are hollow to minimize the weight of the razor blade holder and to enable the quick and inexpensive forming thereof. Further, the finger gripping elements is preferably in the form of a tetrahedron so as to provide a number of flat finger engaging surfaces and hence facilitate manipulation of the holder to enable a desired cutting angle to be consistently maintained during the cutting operation. More particularly, each tetrahedral finger grip 12, 14 has a base wall defined by its respective longitudinal wall element 22,24, first 42, 44 and second side walls 46, 48 defined in planes offset angularly relative to the longitudinal axis of the longitudinal wall element and at an angle relative to a plane parallel to the longitudinal wall and a third side wall 50, 52 defined substantially parallel to the longitudinal axis of the longitudinal wall element but displaced angularly from a plane parallel to the longitudinal wall element. As is apparent, the three dimensional configuration of the razor blade holder enables it to be easily picked up and rested conveniently in the hand of the user. In addition, it is easier to spot amidst shuffled papers on a working surface and it can not easily slide or roll on a table. As is further apparent from the foregoing description, the blade can be either inserted into the holder so as to have its cutting portion exposed for use or can be turned around so that only the protective edge is exposed to minimize the likelihood that a user will be cut thereby.

For the manufacture of the illustrated embodiment, only a single design and one set of dimensions is necessary from which the two parts can be formed. The shape of each part is preferably die cut by stamping the form out of a stainless steel sheet. Each finished holder uses two such stamped forms which are each folded identically but oppositely as mirror images into the shapes of tetrahedrons with a longitudinal wall element. Each part includes two cuts out, a notch and a tooth which serve which provide the interlocking structure when two parts are mated together. Further, each stamped form preferably includes a longitudinal strip which is deformed so as to form the clamping means in the present invention.

While in the illustrated embodiment the razor blade holder is formed from first and second parts stamped from a sheet metal, such as stainless steel. It is to be understood that the holder could be formed from any suitable material such as a thermoplastic material with solid or hollow finger gripping portions on each side thereof. It is also to be understood that while in the illustrated embodiment the holder is formed from first and second mirror image parts, the holder could be integrally formed so as to provide a unitary structure of plastic, metal or other suitable material and/or with finger grips that have different shapes from one another without departing from the spirit and scope of this invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A razor blade holder comprising:

slot defining means for receiving a razor blade, said slot defining means having a length parallel to a longitudinal edge of the razor blade when inserted in said slot defining means;

at least one clamping means defined within said slot defining means for clamping a razor blade within said slot; and first and second finger gripping means mounted to first and second longitudinal sides of the said slot defining means, respectively, and extending laterally outwardly therefrom, so that a said finger gripping means is disposed on either longitudinal side of a razor blade within said slot, said first and second finger gripping means being offset from one another along said length of said slot defining means.

2. A razor blade holder as in claim 1, wherein there are two clamping means, each defined adjacent a longitudinal edge of said slot so as to frictionally clamp a side of the razor blade adjacent a longitudinal edge thereof.

3. A razor blade holder as in claim 1, wherein slot defining means includes first and second longitudinal wall elements rigidly coupled together so as to define therebetween said slot.

4. A razor blade holder as in claim 3, wherein said clamping means comprises a protrusion formed on a longitudinal wall of said slot for frictionally engaging a side of the razor blade adjacent a longitudinal edge of the razor blade.

5. A razor blade holder as in claim 4, wherein there are two clamping means, each defined adjacent a longitudinal edge of said slot.

6. A razor blade holder as in claim 5, wherein one of said clamping means is mounted to said first longitudinal wall element and the other of said clamping means is mounted to said second longitudinal wall element.

7. A razor blade holder as in claim 6, wherein each of said clamping means includes an inclined face and a stop face so that each clamp deflects and clamps blades inserted into the slot towards the inclined face thereof and limits the insertion of blades inserted towards the stop face thereof.

8. A razor blade holder as in claim 3, wherein each said longitudinal wall element is formed from a sheet of metal and said clamping means is formed by stamping a portion of said longitudinal element so as to form a blade engaging protrusion.

9. A razor blade holder as in claim 3, wherein each finger gripping means is mounted to a longitudinal wall element.

10. A razor blade holder as in claim 9, wherein each said finger gripping means is mounted so as to extend outwardly from said slot on a side thereof opposite the side defined by its respective longitudinal wall element.

11. A razor blade holder as in claim 10, wherein said first and second longitudinal wall elements are rigidly coupled together by means of an interlocking relation between a tooth element formed on each said finger gripping means and a notch defined in the longitudinal wall element to which the other finger gripping means is mounted.

12. A razor blade holder as in claim 10, wherein each said finger gripping means comprises a three-dimensional tetrahedral element having a base wall defined by its respective longitudinal wall element, first and second side walls defined in planes offset angularly relative to the longitudinal axis of said longitudinal wall element and at an angle relative to a plane parallel to said longitudinal wall element and a third side wall defined in a plane substantially parallel to said longitudinal axis of said longitudinal wall element but displaced angularly relative to a plane parallel to said longitudinal wall element.

13. A razor blade holder as in claim 11, wherein each said finger gripping means comprises a three-dimensional tetrahedral element having a base wall defined by its respective longitudinal wall element, first and second side walls defined in planes offset angularly relative to the longitudinal axis of said longitudinal wall element and at an angle relative to a plane parallel to said longitudinal wall element and a third side wall defined in a plane substantially parallel to said longitudinal axis of said longitudinal wall element but displaced angularly relative to a plane parallel to said longitudinal wall element.

14. A razor blade holder as in claim 13, wherein said first side wall of each said finger grip includes said tooth element and second side wall of each said finger gripping element defines a forward and rearward end of said holder, respectively.

* * * * *